United States Patent [19]

Lore

[11] 4,074,470

[45] Feb. 21, 1978

[54] ANTI-CHATTERING, GRINDING COUNTERBALANCE DEVICE

[76] Inventor: Nicola Lore, 35 Burkhardt Ave., Bethpage, N.Y. 11714

[21] Appl. No.: 755,953

[22] Filed: Jan. 3, 1977

[51] Int. Cl.[2] ..... B24B 41/06
[52] U.S. Cl. ..... 51/238 S
[58] Field of Search ..... 51/238 S, 238 R

[56] References Cited

U.S. PATENT DOCUMENTS

| | | | |
|---|---|---|---|
| 14,299 | 5/1917 | Peterson | 51/238 S |
| 952,193 | 3/1910 | Hanson | 51/238 S |
| 1,416,462 | 5/1922 | Hanson | 51/238 S |

FOREIGN PATENT DOCUMENTS

| | | | |
|---|---|---|---|
| 16,042 of | 1904 | United Kingdom | 51/238 S |

OTHER PUBLICATIONS

"Spring Rest Steadies Small Rods while Grinding", Machinery, Jan. 1945, p. 204.

*Primary Examiner*—Harold D. Whitehead
*Attorney, Agent, or Firm*—Richard L. Miller

[57] ABSTRACT

A fixture for aiding in the support of a work during a grinding operation so that the work does not chatter; the fixture including a base block for being stationarily positioned, the block supporting a pivotable rocking lever which at its one end bears against the work and which at its other end adjustably supports weights so a desired force of the first said end of the lever is applied to the work.

1 Claim, 5 Drawing Figures

ANTI-CHATTERING, GRINDING COUNTERBALANCE DEVICE

This invention relates generally to grinding machine fixtures.

It is generally well known to most persons who are acquainted with machine shop practice that a work held at its one end in a rotating chuck is subject at its other end to not turn true so that it chatters instead, during a grinding operation. This is undesirable when accuracy in a grinding is wanted.

Accordingly, it is a principal object of the present invention to provide a device that eliminates a chattering of a work during the grinding operation.

Another object is to provide an anti-chattering, grinding device which promotes a greater accuracy in a grinding operation.

Still another object is to provide an anti-chattering, grinding device which utilizes a principle of counterbalance in order to maintain a work from chattering.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
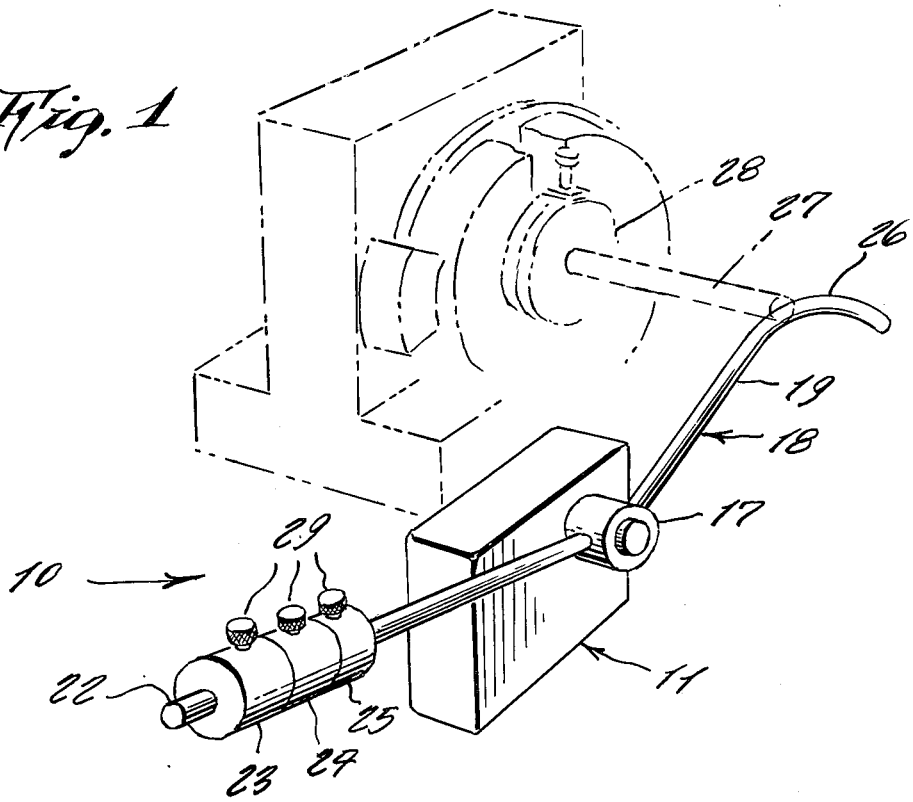
FIG. 1 is a perspective view of the invention shown in use.
Figure 2:
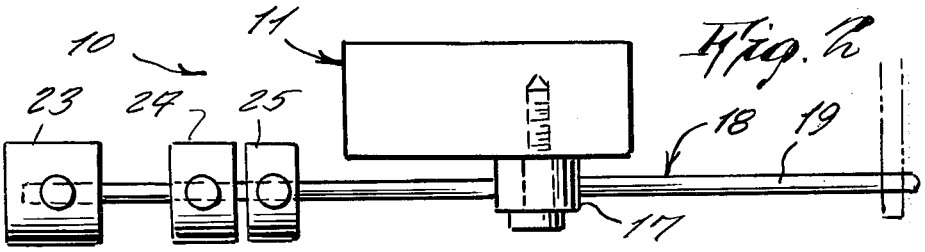
FIG. 2 is a top view of the invention.
Figure 3:
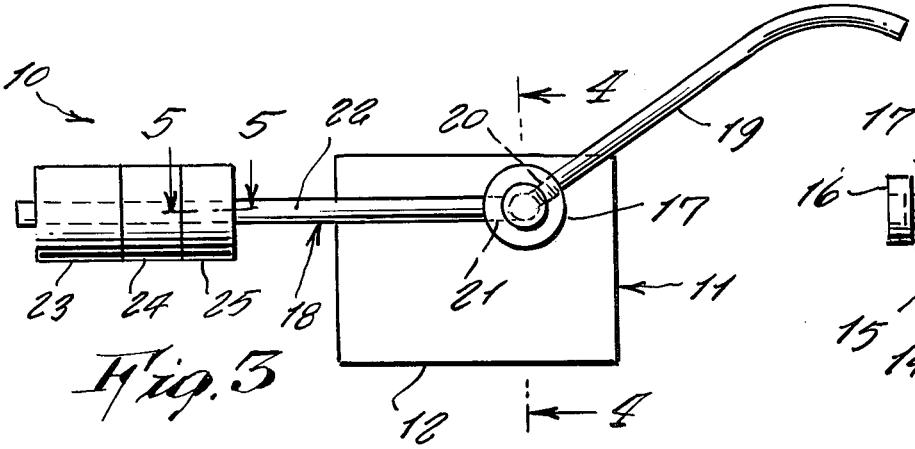
FIG. 3 is a side view.
Figure 4:
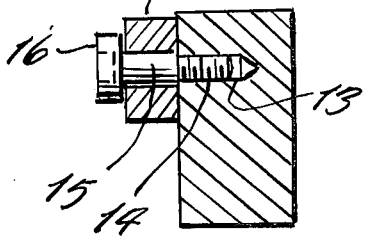
FIG. 4 is a cross-sectional view on line 4—4 of FIG. 3.
Figure 5:
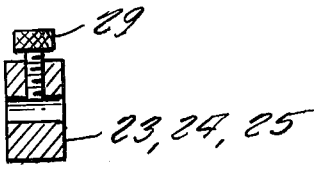
FIG. 5 is a cross-sectional view on line 5—5 of FIG. 3.

Referring now to the drawing in greater detail, the reference numeral 10 represents an anti-chattering, grinding counterbalance device according to the present invention wherein the same includes a base block 11 made of solid steel or other heavy metal and which has a ground bottom face 12 for resting on a supporting surface.

A threaded opening 13 on a side of the block is engaged by a screw 14 having an outwardly projecting, cylindrical, diametrically enlarged shoulder 15 located adjacent a further diametrically enlarged head 16.

A cylindrically collar 17 is supported freely rotatable on the shoulder 15 of the screw.

The collar 17 comprises one component of a lever 18 that rocks relatively friction free on the screw shoulder. The lever includes a rod 19 which at one end is force-fitted into an opening 20 extending radially on the collar. Another radially extending opening 21 on the collar is located approximately 135° away from the threaded opening 20 and is press-fitted with one end of a straight rod 22.

A plurality of various sized weights 23, 24 and 25 are adjustably mountable along the rod 22 so to obtain a desired counterbalance force for an arcuate end 26 of the rod 19 which in operative use bears against a side of an unsupported end of a work 27 which is supported in a chuck 28.

Each weight is stationarily securable on the rod 22 by means of a thumb screw 29, or any other suitable method.

In operative use, it is now evident that the counterbalanced lever will maintain the free end of the work steady so to not chatter while being ground.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. An anti-chattering, grinding, counterbalance device, comprising in combination, a heavy base block supporting pivotally free a rocking lever, one end of said rocking lever adjustably supporting a plurality of counterbalancing weights while an opposite end of said rocking lever bears against a side surface of a free end of a work supported at its other end in a chuck during a grinding operation; a screw secured to a side of said base block having a shoulder around which said rocking lever pivots; said rocking lever being comprised of a collar pivoted around said screw shoulder, a pair of rods secured radially to said collar a first said rod being straight throughout its length and on which said weights are supported, and the other said rod having an accurate end being all on a flat plane that is at right angle to a longitudinal axis of said screw; each said weight being securable on said rod by a set screw.

* * * * *